US009752371B2

(12) United States Patent
Seo et al.

(10) Patent No.: US 9,752,371 B2
(45) Date of Patent: Sep. 5, 2017

(54) METHOD AND SYSTEM FOR CONTROLLING OPENING AND CLOSING VEHICLE DOOR

(71) Applicant: Hyundai Motor Company, Seoul (KR)

(72) Inventors: Yongdae Seo, Gyeonggi-do (KR); Soonchan Kwon, Incheon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 15/089,786

(22) Filed: Apr. 4, 2016

(65) Prior Publication Data

US 2017/0167181 A1 Jun. 15, 2017

(30) Foreign Application Priority Data

Dec. 14, 2015 (KR) ..... 10-2015-0178136

(51) Int. Cl.
*E05F 15/77* (2015.01)

(52) U.S. Cl.
CPC ..... *E05F 15/77* (2015.01)

(58) Field of Classification Search
CPC combination set(s) only.
See application file for complete search history.

(56) References Cited

U.S. PATENT DOCUMENTS

2012/0280791 A1* 11/2012 Kim ..... E05B 77/14 340/5.72
2014/0197730 A1* 7/2014 Spence ..... B60Q 1/2669 315/80

* cited by examiner

*Primary Examiner* — Thomas G Black
*Assistant Examiner* — Ana Thomas
(74) *Attorney, Agent, or Firm* — Mintz Levin Cohn Ferris Glovsky and Popeo, P.C.; Peter F. Corless

(57) ABSTRACT

A method and a system for controlling the opening/closing of a vehicle door are provided. The method includes determining whether a door is in a locked state and when the door is determined to be in the locked state, determining whether a smart key is within a predetermined distance. When the smart key is determined to be within the predetermined distance, a door latch module is changed to a "ready-to-open" state in the locked state of the door. The method further includes determining whether the smart key is maintained to be within the predetermined distance and operating an exterior handle of the door. When the exterior handle is operated, the door is opened and locking of the door is released simultaneously.

8 Claims, 2 Drawing Sheets

METHOD AND SYSTEM FOR CONTROLLING OPENING AND CLOSING VEHICLE DOOR

CROSS-REFERENCE TO RELATED APPLICATION

This application claims priority to and the benefit of Korean Patent Application No. 10-2015-0178136 filed in the Korean Intellectual Property Office on Dec. 14, 2015, the entire contents of which are incorporated herein by reference.

BACKGROUND (a) Field of the Invention

The present invention relates to a method and a system for controlling the opening and closing of a vehicle door, and more particularly, to a method and a system for controlling the opening and closing of a vehicle door in a vehicle to which a smart key is applied in which the door is opened by merely operating an exterior handle of the door to unlock the door when the smart key in within a particular distance range.

(b) Description of the Related Art

In general, a vehicle is formed with an interior for accommodating a driver or accompanying passengers, and doors are mounted on the vehicle to open and close the interior of the vehicle. In the case of a passenger vehicle, front doors are mounted on a front side of the vehicle along a length direction thereof, and rear doors are mounted on a rear side of the vehicle along the length direction thereof, and the front and rear doors are typically mounted on a vehicle body and are rotatable via a hinge.

A ratchet is mounted on the door to allow a user to close the door. In addition, after the door is closed, a door lock striker is mounted on the vehicle body at a corresponding mounting position of the ratchet. The door lock striker is mounted as a pin or hook type, and the door lock striker is engaged with the ratchet embedded in the door to maintain the door in a closed state. In addition, on the exterior of the vehicle, a handle for operating the ratchet is provided. The user uses a key to unlock the door, and operates the exterior handle to open the door.

Meanwhile, a smart key has recently been developed for vehicles. In a vehicle to which a smart key is applied, a user in possession of the smart key is able to unlock a door by pressing or engaging an unlocking button disposed on an exterior handle (e.g., by placing a finger on the sensor, the door may be unlocked when the user is in possession of the smart key). After that, the user may open the door by pulling the exterior handle. However, as described above, the vehicle to which a smart key according to the related art is applied has a drawback in that it requires two steps of operations for the user to enter the vehicle, since the user is required to open the door after operating the unlocking button mounted on the handle.

In addition, since the unlocking button is mounted on the exterior handle, the external appearance of the handle may be undesirable. Further, since the unlocking button is disposed within a limited area of the handle, there is a limitation in design of the unlocking button, in addition to generation of field claims due to frequent faults of the unlocking button.

The above information disclosed in this section is merely to enhance the understanding of the background of the invention and therefore it may contain information that does not form the prior art that is already known in this country to a person of ordinary skill in the art.

SUMMARY

The present invention provides a method and a system for controlling opening and closing of a vehicle door for a vehicle to which a smart key is applied, from which an unlocking button or unlocking sensor may be omitted, and in which a user who possesses a smart key may merely operate an exterior handle of a door and open the door simultaneously.

A method for controlling the opening and closing a vehicle door according to an exemplary embodiment of the present invention may include: determining whether a door is in a locked state; when the door is determined to be in the locked state, determining whether a smart key is within a predetermined distance from the vehicle; when the smart key is determined to be within the predetermined distance, changing, by a controller, a door latch module to a "ready-to-open" state in the locked state of the door; determining whether the smart key is maintained to be within the predetermined distance from the vehicle; operating an exterior handle of the door; and when the exterior handle is operated, opening the door and releasing locking of the door simultaneously.

After the opening of the door and the releasing of the locking of the door simultaneously, a door-open (AJAR) signal may be generated by the opened door, and releasing locking of all doors may be performed by operating a locking unit. In the determination of whether the smart key is maintained within the predetermined distance, when the smart key is determined to be beyond the predetermined distance (e.g., out of the distance range), a "ready-to-open" state of the door latch module may be released in the locked state of the locking unit to return to the determination of whether the smart key is within the predetermined distance. A sensing unit (e.g., a sensor) may be mounted within the exterior handle to sense an output signal generated from the smart key and to output the sensed signal to the controller.

A door opening/closing system for a vehicle according to an exemplary embodiment of the present invention may include: a sensing unit configured to sense a smart key output signal; a door latch module configured to selectively open/close a door based on whether an exterior handle of the door is operated; a locking unit configured to maintain or release a locked state of the door; and a controller configured to selectively operate the locking unit and the door latch module based on an output signal output from the sensing unit.

The sensing unit may be mounted within the exterior handle. Additionally, the sensing unit may be configured to sense an output signal generated from the smart key and to output the sensed signal to the controller when the smart key is in proximity of a vehicle. The door may be opened and unlocked simultaneously when the exterior handle is operated when the smart key is already in proximity of the vehicle (e.g., within the predetermined distance from the vehicle). The door latch module may be changed by the controller to a "ready-to-open" state when a user who possesses the smart key approaches the vehicle (e.g., enters the predetermined distance range).

As described above, according to the method and the system for controlling opening/closing a vehicle door according to the current exemplary embodiment of the present invention, the unlocking button or the unlocking sensor may be omitted from the vehicle to which a smart key is applied, and the user may unlock and open the door simultaneously by operating the exterior handle of the door, thereby simplifying the operations and thus improving ease of use and its commercial value. In addition, since the unlocking button or the unlocking sensor which is applied to conventional outside handles may be omitted, the external appearance of the exterior handle may be improved, a manufacturing cost may be reduced while preventing the field claims from being generated due to a fault of the unlocking button or the unlocking sensor.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF SYMBOLS

Figure 1:
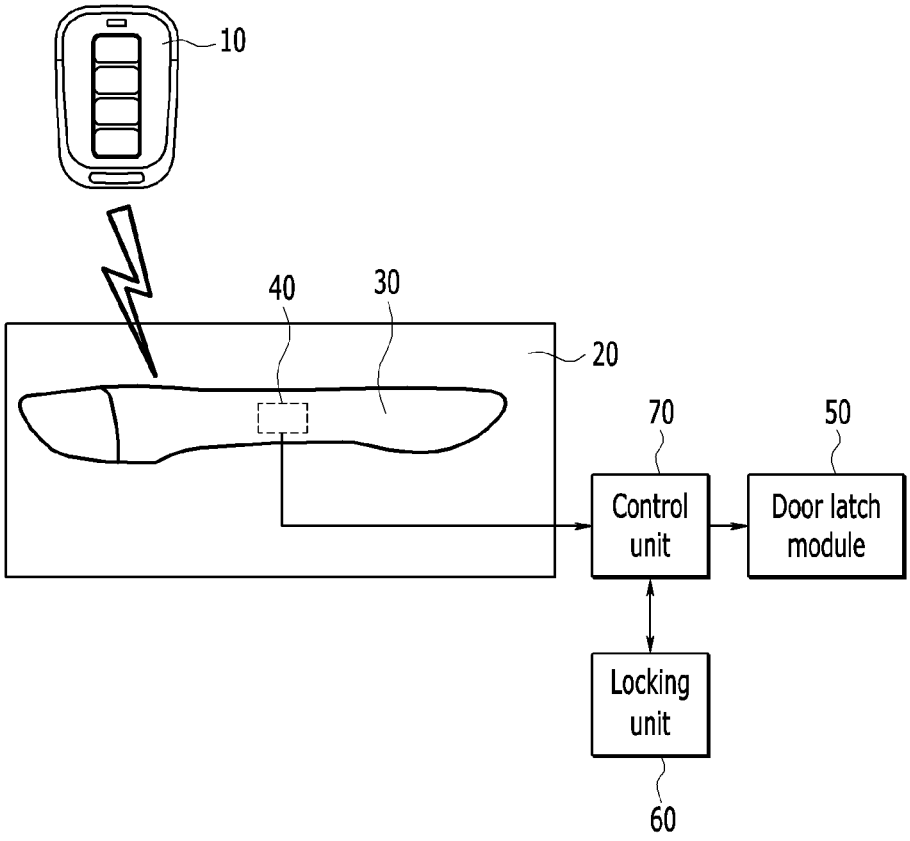
FIG. 1 is a schematic diagram of a system for opening/closing a vehicle door according to an exemplary embodiment of the present invention.

1: system for opening/closing door
10: smart key
20: door
30: exterior handle
40: sensing unit
50: door latch module
60: locking unit
70: controller

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

An exemplary embodiment of the present invention will hereinafter be described in detail with reference to the accompanying drawings.

Before starting description of the present invention, since it is required to understand that the exemplary embodiment described in the specification and the configurations shown on the drawings are no more than an exemplary embodiment of the present invention, but not represent entire technical aspects of the present invention, at the time of filing of the present invention, there may be different equivalents and variations that can substitute the embodiment and the configurations. Parts not relevant to the present invention will be omitted for describing the present invention clearly, and throughout the specification, identical or similar parts will be given the same reference numbers.

Since sizes and thicknesses of elements are shown at will for convenience of description, the present invention is not limited to the drawings without fail, but the thicknesses are enlarged for expressing different parts and regions, clearly. Throughout the specification, unless explicitly described to the contrary, the word "comprise" and variations such as "comprises" or "comprising" will be understood to imply the inclusion of stated elements but not the exclusion of any other elements. In addition, the terms such as "unit", "means", "part", "member", etc. described in the specification means a unit that processes at least one function or an operation.

FIG. 1 is a schematic diagram of a system for opening/closing a vehicle door according to an exemplary embodiment of the present invention. The system 1 for opening/closing a vehicle door according to the current exemplary embodiment of the present invention may be applied to a vehicle to which a smart key 10 is applied. The system 1 for opening/closing a vehicle door allows a user who possesses the smart key 10 to unlock and open a door 20 simultaneously by pulling an exterior handle 30 mounted on the door 20 without requiring a separate operation of unlocking the door 20.

The system 1 for opening/closing a vehicle door may include, as illustrated in FIG. 1, a sensing unit 40, a door latch module 50, a locking unit 60, and a controller 70. The sensing unit 40 (e.g., a sensor) may be configured to sense an output signal generated from the smart key 10 and may be mounted within the exterior handle 30. In addition, when the smart key 10 is in proximity of the vehicle (e.g., within a predetermined distance range of the vehicle), the sensing unit 40 may be configured to sense the output signal generated from the smart key 10, and output the sensed signal to the controller 70.

Meanwhile, in the present exemplary embodiment, the exemplary embodiment in which the sensing units 40 (e.g., a first and second sensing unit) are respectively mounted within the exterior handle 30 is described, but it is not limited thereto, and the sensing unit 40 may be mounted within the vehicle including the exterior handle 30, for example, anywhere of the vehicle including an engine compartment, inside of the dash panel, and inside of the door. In particular, the sensing unit 40 may be divided up in to a first and second sensing unit to be disposed within different exterior door handles (e.g., driver and passenger door handles).

Further, the door latch module 50 may be disposed inside of the door, and may be engaged with the striker included in the vehicle body not illustrated to maintain the door 20 in a closed state, or may be disengaged from the striker to open the door 20 when the exterior handle 30 or an inside handle (not shown) is operated. When the user in possession of the smart key 10 is in proximity to the vehicle (e.g., within about 2 to 3 m from the vehicle), the door latch module 50 may be changed by the controller 70 to a "ready-to-open" state. When the door 20 is closed toward the vehicle, the locking unit 60 may maintain or release the locked state of the door 20.

In addition, the controller 70 may be configured to selectively operate the door latch module 50 and the locking unit 60 based on the output signal output from the sensing unit 40. Particularly, when the exterior handle 30 is operated by the user after the smart key 10 is already in proximity to the vehicle, the door 20 may be opened and locking of the corresponding door 10 which is opened may be released simultaneously. In other words, in the system 1 for opening/closing a vehicle door according to the current exemplary embodiment of the present invention, since the conventional unlocking button or the unlocking sensor included in the exterior handle 30 may be eliminated, the driver or the user in possession of the smart key 10 may unlock the door 20 and open the door 20 simultaneously by pulling the exterior handle 30.

Figure 2:
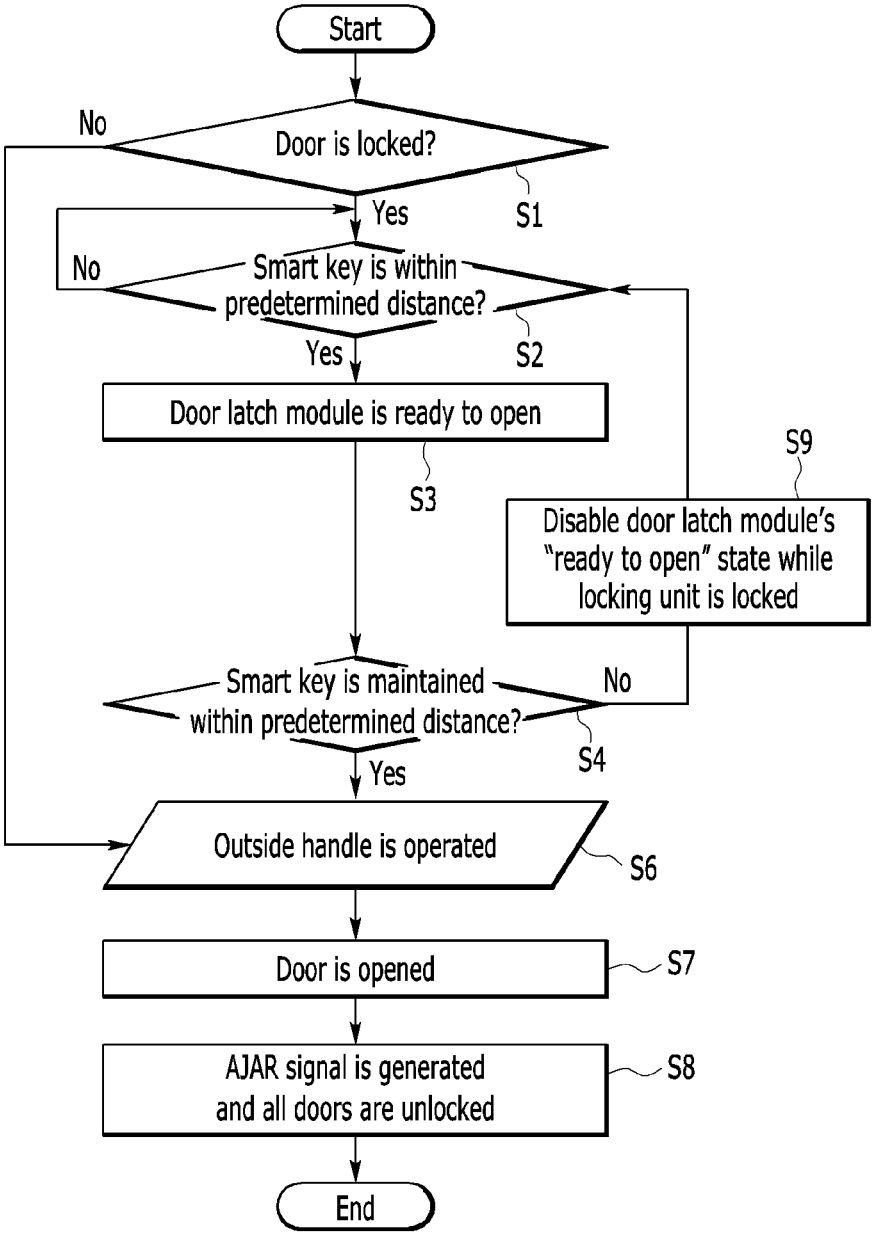
FIG. 2 is a control flowchart illustrating a method for controlling opening/closing a vehicle door according to an exemplary embodiment of the present invention.

A method for controlling opening/closing a door of a vehicle to which the system 1 for opening/closing a vehicle door configured as described above is applied will now be described in detail. FIG. 2 is a control flowchart illustrating a method for controlling opening/closing a vehicle door according to an exemplary embodiment of the present invention. As shown in FIG. 2, a controller 70 may be configured to determine whether a door 20 is in a locked state (S1). When the door 20 is determined to be in the locked state, the controller 70 may be configured to determine whether a smart key 10 approaches within a predetermined distance in a periphery of the vehicle (S2).

Herein, an output signal generated from the smart key 10 may be sensed by a sensing unit 40 mounted within an exterior handle 30, and the sensing unit 40 may be configured to output the sensed signal to the controller 70. When the smart key 10 is determined to be beyond the predetermined distance from the vehicle (e.g., beyond the distance range), the process may return to determining whether the smart key 10 is within the predetermined distance (S2). Further, when the smart key 10 is determined to be within the predetermined distance from the vehicle, the controller 70 may be configured to change the door latch module 50 to a "ready-to-open state" while maintaining the door 20 in the locked state (S3). In particular, the "ready-to-open" state of the door latch module 50 may be changed by a separate actuator included in the door latch module 50 and using a separate link connected to the actuator.

Subsequently, whether the smart key 10 is maintained within the predetermined distance may further be determined (S5). When the smart key 10 is determined to be within the predetermined distance, the exterior handle 30 of the door 20 may be operated (S6). In particular, the operation of the exterior handle 30 indicates a pull operation of the exterior handle 30 performed by a user. When the exterior handle 30 is operated, the door 20 in which the exterior handle 30 is operated may be opened and unlocked simultaneously (S7).

After the simultaneous opening of the door 20 and unlocking of the door 20 (S7), a door-open (AJAR) signal may be generated by the opened door 20. In particular, the controller 70 may be configured to operate the locking unit 60 based on the output door-open (AJAR) signal, release all locking of the door 20 (S8), and terminate the operation.

Meanwhile, in the above, when the smart key 10 is determined to be beyond the predetermined distance, the controller 70 may be configured to release the "ready-to-open" state of the door latch module 50 while maintaining the locked state of the door 20 by operating the locking unit (S9), and the process may return to the determining whether the smart key 10 is within the predetermined distance (S2), thereby repeating the steps described above. In other words, in the method for controlling opening/closing a vehicle door according to the current exemplary embodiment of the present invention, the steps described above may be performed while allowing the user in possession of the smart key 10 to open the door 20 by pulling the exterior handle 30.

Accordingly, in accordance with the method and the system 1 for controlling opening/closing a vehicle door according to the current exemplary embodiment of the present invention, the unlocking button or the unlocking sensor may be eliminate from the vehicle to which a smart key 10 is applied, and the user may be allowed to unlock and open the door simultaneously by merely operating the exterior handle 30 of the door 20, thereby simplifying the operations and thus improving ease of use and its commercial value. In addition, since the unlocking button or the unlocking sensor which is conventionally applied to the exterior handle 30 may be eliminated, the external appearance of the exterior handle 30 may be improved, a manufacturing cost may be reduced while preventing the field claims from being generated due to a fault of the unlocking button or the unlocking sensor.

While this invention has been described in connection with what is presently considered to be exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. A method for controlling opening and closing a vehicle door, comprising:

determining, by a controller, whether a door is in a locked state;

determining, by the controller, whether a smart key is within a predetermined distance from the vehicle using a sensor when the door is determined to be in the locked state;

changing, by the controller, a door latch module to a "ready-to-open" state in the locked state of the door when the smart key is determined to be within the predetermined distance;

determining, by the controller, whether the smart key is maintained to be within the predetermined distance;

operating, by the controller, an exterior handle of the door; and opening the door and releasing locking of the door, by the controller, simultaneously when the exterior handle is operated, wherein after the simultaneous opening of the door and releasing of the locking of the door, a door-open (AJAR) signal is generated by the opened door, and the controller is configured to release the locking of all doors by operating a locking unit, and a sensing unit is mounted within the exterior handle and configured to sense an output signal generated from the smart key and to output the sensed signal to the controller.

2. The method of claim 1, wherein in the determination of whether the smart key is maintained within the predetermined distance, when the smart key is determined to be beyond the predetermined distance, a "ready-to-open" state of the door latch module is released in the locked state of the locking unit to return to the determination of whether the smart key is within the predetermined distance.

3. A system for opening/closing a vehicle door, comprising:

a sensing unit mounted within an exterior handle of a door and configured to sense a smart key output signal;

a door latch module configured to selectively open/close the door based on whether the exterior handle of the door is operated;

a locking unit configured to maintain or release a locked state of the door; and a controller configured to selectively operate the locking unit and the door latch module based on an output signal output from the sensing unit, wherein the door is opened and unlocked simultaneously when the exterior handle is operated when the smart key is in proximity to the vehicle.

4. The system of claim 3, wherein the sensing unit is mounted within the exterior handle.

5. The system of claim 3, wherein the sensing unit is configured to sense an output signal generated from the smart key and to output the sensed signal to the controller when the smart key is in proximity to a vehicle.

6. The system of claim 3, wherein the door latch module is changed by the controller to a "ready-to-open" state when the smart key approaches the vehicle.

7. The system of claim 6, wherein the smart key approaches the vehicle when the smart key is determined to be within a predetermined distance from the vehicle.

8. The system of claim 3, wherein after the simultaneous opening of the door and releasing of the locking of the door, a door-open (AJAR) signal is generated by the opened door, and the controller is configured to release the locking of all doors by operating a locking unit.

* * * * *